United States Patent [19]

Carver

[11] 4,378,233

[45] Mar. 29, 1983

[54] METAL BONDED GRINDING WHEEL CONTAINING DIAMOND OR CBN ABRASIVE

[75] Inventor: Edgar B. Carver, Whitinsville, Mass.

[73] Assignee: Norton Company, Worcester, Mass.

[21] Appl. No.: 286,409

[22] Filed: Jul. 24, 1981

[51] Int. Cl.[3] ..... C09K 3/14

[52] U.S. Cl. ..... 51/298; 51/307; 51/309

[58] Field of Search ..... 51/298, 295, 309, 307

[56] References Cited

U.S. PATENT DOCUMENTS

| | | | |
|---|---|---|---|
| 3,293,012 | 12/1966 | Smiley | 51/309 |
| 3,904,391 | 9/1975 | Lindstrom et al. | 51/295 |
| 3,912,500 | 10/1975 | Vereschagin | 51/309 |
| 3,925,035 | 12/1975 | Keat | 51/309 |
| 3,957,461 | 5/1976 | Lindstrom et al. | 51/298 |
| 4,142,872 | 3/1979 | Conradi | 51/309 |
| 4,246,004 | 1/1981 | Busch et al. | 51/295 |

*Primary Examiner*—Donald E. Czaja
*Assistant Examiner*—W. Thompson
*Attorney, Agent, or Firm*—Rufus M. Franklin

[57] ABSTRACT

An improved grinding wheel employing premium abrasive (diamond or cubic boron carbide) is made by employing a metal bond made from aluminum, zinc, copper, and tin, and including up to 50% of a dry film lubricant filler. The abrasive elements produced are particularly useful to form cup wheels for the dry grinding of carbide and tool steel.

4 Claims, No Drawings

METAL BONDED GRINDING WHEEL CONTAINING DIAMOND OR CBN ABRASIVE

BACKGROUND OF THE INVENTION

While metal bonds for diamond and cubic boron nitride wheels are known, such wheels have not, to the time of this invention, been the preferred type of wheel for grinding cemented carbide tools. Although U.S. Pat. No. 3,925,035, which teaches the use of a graphite filled bronze or similar type of bond, is outstanding in terms of G ratio (volumetric ratio of material removed to wheel wear), it has inadequate chip resistance to successfully compete with diamond wheels made with resinoid type bonds in general purpose applications. The object of the present invention is to provide a lubricant filled metal bond for diamond or cubic boron nitride (premium abrasives) wheels which significantly outperforms prior art resinoid wheels in terms of G ratio, and has sufficient chip and spall resistance to compete effectively in general purpose grinding of cemented carbides and hard steels.

SUMMARY OF THE INVENTION

The bond material employed to make premium abrasive wheels of the present invention includes the four metals: aluminum, zinc, copper, and tin, and which may include up to 50% by volume of an inorganic particulate dry film lubricant such as graphite, hexagonal boron nitride, and molybdenum disulfide. Organic dry film lubricant filler can also be used. Organic dry-film lubricants are finely divided solid polymeric materials. Suitable materials are extrusion grades of acrylonitrile-butadiene-styrene terpolymers, acetal copolymers (polyformaldehyde), chlorinated polyethers, polytetrafluoroethylene, polychlorotrifluoroethylene, fluorinated ethylene propylene, polyvinylidene fluoride, ionomers, nylons, polyphenylene oxides, polyvinyl chloride, polyvinylidene chloride, polycarbonates, thermoplastic polyesters, flexible polyesters, polyethylene, polysulfones, styrene butadiene copolymers, and urethanes. When filler is included, as in wheels for grinding of cemented carbide, the preferred addition is 10 to 50%.

The wheels are made by attaching the grinding elements of the invention, normally in the form of a ring, to a wheel core. The grinding elements are made by hot pressing, in a mold of the desired size and shape, a mixture of the abrasive, particulate filler, and the metal powders. The metal powders may be in elemental form or may be in the form of pre-alloyed powders.

In terms of volume % of the metal phase or phases of the bond, the amounts of the four metals useful in my invention, while not critical in terms of exact amounts, may be set at 20 to 70% copper, 5 to 30% tin, 5 to 30% aluminum, and 10 to 35% zinc.

The diamond or cubic boron nitride employed in making the abrading tools of this invention may range in size from 325/400 grit to 80/100 grit, and are the relatively weak, synthetic or natural grits, designed for use in resinoid bonds, particularly for the grinding of cemented carbide, such as cobalt bonded tungsten carbide, or they may be the blocky strong diamonds designated as metal bond diamonds. They may be multicrystalline and weak shaped (i.e. not blocky shaped), as are the synthetic diamonds of this type, or they may be natural monocrystalline grits having a strong or weak (elongated) shape. The diamonds may be metal clad.

The cladding may be nickel, copper, or other metal as suggested in U.S. Pat. No. 3,904,391. The cladding should be present in the amount up to 70%, by volume, based on the composite volume of the diamond plus the coating. For cemented carbide grinding diamond grit, preferably of the weaker (resin bond) type is preferred.

For applications involving the grinding of tool steels, cubic boron nitride, or combinations of cubic boron nitride with diamond, may be employed. The cubic boron nitride may be metal (e.g. nickel) clad.

PREFERRED EMBODIMENT OF THE INVENTION

To date, optimum results, in the dry grinding of cobalt bonded tungsten carbide and tungsten carbide-steel combinations, have been achieved with a $3\frac{3}{4}''$ diameter D11V9 cup wheel having a $\frac{1}{8}$ inch deep diamond section in which the diamond section contained 20% by volume graphite having a particle size of 1–10 microns and a metal phase comprising hot pressed powders of Al, Zn, Cu, and Sn. The volume composition of the metal phases was: 53.75 Cu, 27.5% Sn, 6.25% Al, and 12.5% Zn.

The elemental metal powders were thoroughly mixed with the diamond and graphite and the mixture was hot-pressed at 5 tons/square inch at 350° C. for 10 minutes in a mold of standard configuration. The diamond was copper clad, 50% copper by volume of the copper and diamond.

In comparison with a standard commercial resinoid wheel (Norton B-56 bond) of equal diamond content, and equal size and geometry, the wheel of the above example had a G ratio 20.6 times that of the resinoid wheel, in the dry grinding of cemented tungsten carbide under identical conditions. The power draw for the wheel of the invention was 750 watts versus 1550 for the resin bonded wheel. The machine was a horizontal spindle surface grinder. The table speed was 72 inches per minute, the infeed was 1.6 mils per pass, and the grinding rate was approximately 0.054 cubic inches per minute. Furthermore the wheel was at least equivalent to the resinoid wheel in resistance to chipping and spalling.

In dry grinding a tungsten carbide/10% steel combination, the above example had a G ratio 10.8 times that of the resinoid wheel. The power draw for the wheel of the invention was 575 watts versus 1250 for the resinoid wheel. A lower power draw is advantageous because it means the invention is capable of removing material more quickly than are conventional bonds. The capability offers the opportunity for users of the wheel to improve productivity.

Method of Test

Machine: Norton S-3 surface grinder Eq. No. 31230 equipped with a rotary head to simulate a milling cutter.

Wheel Speed: 3600 r.p.m.

Table Traverse: 72 in/min.

Unit Infeed: 1.6 and 2.0 mils

Total Infeed: 50 mils on 10%, 48 mils on 20% and 50 mils on pure carbide.

The material ground was $5/32 \times \frac{1}{2}''$, 44A cemented tungsten carbide brazed to $1/16 \times \frac{1}{2}''$ steel ground to the thickness of 0.205", with 10% of the thickness being steel, and pure cemented carbide pieces, $\frac{1}{2} \times \frac{1}{4}''$ with an area of 2.9 $in^2$.

What is claimed is:

1. A grinding wheel including an abrasive portion of diamond abrasive grits, or cubic boron nitride grits bonded in a metal matrix, said matrix consisting of metallic phase and up to 50% by volume, a dispersed particulate lubricant filler, said metal phase consisting essentially of a hot-pressed mixture of finely particulate aluminum 5 to 30%, zinc 10 to 35%, copper 20 to 70%, and tin 5 to 30%, all by volume.

2. A grinding wheel as in claim 1 in which the particulate filler is selected from the group consisting of polytetrafluoroethylene, graphite, molybdenum disulfide, hexagonal boron nitride, and mixtures thereof.

3. A grinding wheel as in claim 1 in which the particulate filler is present in the amount of 15 to 50% by volume of the composite of diamond, metal, and filler.

4. A grinding wheel as in claim 1 in which the diamond or cubic boron nitride is copper clad.

* * * * *